US007524269B2

(12) United States Patent
Postma et al.

(10) Patent No.: US 7,524,269 B2
(45) Date of Patent: Apr. 28, 2009

(54) WALL-CLIMBING ACCESSORY

(75) Inventors: Nathan B. Postma, White Bear Lake, MN (US); Kevin E. Cieszkowski, St. Paul, MN (US)

(73) Assignee: Nicros, Inc., St. Paul, MN (US)

( * ) Notice: Subject to any disclaimer, the term of this patent is extended or adjusted under 35 U.S.C. 154(b) by 495 days.

(21) Appl. No.: 10/999,238

(22) Filed: Nov. 30, 2004

(65) Prior Publication Data

US 2006/0116244 A1 Jun. 1, 2006

(51) Int. Cl.
*A63B 9/00* (2006.01)

(52) U.S. Cl. ..... 482/37

(58) Field of Classification Search ..... 482/35–37; 4/255.11

See application file for complete search history.

(56) References Cited

U.S. PATENT DOCUMENTS

| | | | | | |
|---|---|---|---|---|---|
| 952,495 | A * | 3/1910 | Austin | 248/205.8 |
| 2,607,927 | A * | 8/1952 | Scott | 4/255.11 |
| 4,174,548 | A * | 11/1979 | Dunn | 15/104.33 |
| 5,125,877 | A | 6/1992 | Brewer | |
| 5,242,652 | A | 9/1993 | Savigny | |
| 5,254,058 | A | 10/1993 | Savigny | |
| 5,549,195 | A | 8/1996 | Aulagner | |
| 5,582,580 | A * | 12/1996 | Buckman et al. | 601/41 |
| 5,944,634 | A | 8/1999 | Neves | |
| 6,074,327 | A | 6/2000 | Franklin | |
| 6,402,663 | B1 | 6/2002 | Popp | |
| 6,514,178 | B2 * | 2/2003 | Vettori | 482/37 |
| 6,540,645 | B1 * | 4/2003 | Zeilinger | 482/35 |
| 6,544,145 | B2 | 4/2003 | Yoshida et al. | |
| 6,551,215 | B1 | 4/2003 | Gordon | |
| 6,629,907 | B2 | 10/2003 | Popp | |
| 6,699,158 | B1 | 3/2004 | Richardson | |
| 6,709,365 | B2 | 3/2004 | Zeilinger | |
| 6,915,533 | B1 * | 7/2005 | Gorobets | 4/255.11 |
| 2002/0019297 | A1 | 2/2002 | Vettori | |
| 2002/0022552 | A1 | 2/2002 | Yoshida et al. | |
| 2002/0098949 | A1 | 7/2002 | Popp | |
| 2002/0169052 | A1 | 11/2002 | Godsey | |
| 2003/0013579 | A1 | 1/2003 | Rennex | |
| 2003/0060333 | A1 | 3/2003 | Sudeith | |
| 2003/0153432 | A1 | 8/2003 | Zeilinger | |

* cited by examiner

*Primary Examiner*—Fenn C Mathew
(74) *Attorney, Agent, or Firm*—Moore & Hansen, PLLP

(57) ABSTRACT

A wall-climbing accessory adapted for mounting onto a wall structure is described. The wall-climbing accessory comprises a resilient body that is flexible. The resilient body comprises an exterior surface and an edge. The exterior surface is configured to provide an engagement point capable of supporting a climber of the wall structure, whereby a climber may scale a wall structure by using the wall-climbing accessory. The edge is configured to substantially engage the wall structure such that, when affixed, the resilient body and edge impart a torsion force to the wall structure such that a flexible, friction fit is formed between the wall-climbing accessory and the wall structure. The wall-climbing accessory use only one primary fastener to attach to the wall structure and thus is less prone to rotation than prior art climbing holds. Furthermore, the resilient body is flexible and lighter when compared to prior art climbing holds.

14 Claims, 2 Drawing Sheets

WALL-CLIMBING ACCESSORY

FIELD OF THE INVENTION

The present invention is directed to artificial climbing walls. More specifically, the present invention is directed to a wall-climbing accessory for an artificial climbing wall.

BACKGROUND OF THE INVENTION

The sport of rock climbing is becoming more popular as a means of recreation. In order to develop the necessary skills to participate in this sport, many individuals practice on a simulation device that typically includes a climbing wall containing a plurality of man made climbing holds fastened thereto. Climbing of these man made walls has also become a sport of its own, with walls being designed to accommodate the various skill levels of climbers. In the United States, climbers use a standard rating system to describe the difficulty of different routes. There are six classes in this system, ranging from class one (normal walking) through hiking, scrambling and then climbing at class five. Everything known as "rock climbing" falls in class five. Class six are rock walls that are so smooth that there is no way to climb them without artificial aids (i.e. special climbing ladders or equipment). Within class five there are fourteen different levels that break down in the following manner: 5.0 through 5.4—beginner level which is easy to climb, like a ladder. 5.5 through 5.7—intermediate level which is climbable in normal shoes or boots but requiring more skill. 5.8 through 5.10—experienced level, which requires climbing shoes, experience and strength. 5.11 through 5.12—expert level that perhaps only the top 10% of climbers in the world can climb these routes. 5.13 through 5.14—elite level which can only be climbed by the best of the best.

The basic premise behind rock climbing is extremely simple. The climber is trying to climb from the bottom to the top of something. If that was all there were to it, then the climber would need nothing but his or her body and a good pair of climbing shoes. However, safety issues arise in the sport if the climber slips anywhere along the way. Because of the possibility of falling, rock climbing involves a great deal of highly specialized equipment to catch climbers when they fall.

Part of the specialized equipment includes climbing holds. Climbing holds are grabbed and stepped on by a climber in order to ascend the wall. It is important for the holds to be rigidly secured to the climbing wall in order to prevent the hold from moving under the weight of a climber. Also, climbing holds come in a variety of configurations in order to simulate movement patterns in climbing. Such holds are typically formed of synthetic material such as a polyester resin, which gives hold a rough texture.

There are two conventional types of climbing walls that are used to simulate rock climbing activity. The first type of climbing wall includes a substantially vertical climbing surface that has a rock like texture (See e.g. U.S. Pat. No. 5,254,058 to Savigny, "Artificial climbing wall with modular rough surface", Oct. 19, 1993). The shape or texture of the climbing wall determines the level of difficulty associated with maneuvering around this type of climbing wall. The second type of climbing wall includes rock-like hand and foot holds that are attached to a normal (i.e., substantially smooth) wall (See e.g. U.S. Pat. No. 5,125,877 to Brewer, "Simulated climbing wall," Jun. 30, 1992). There are two ways to adjust the level of difficulty associated with maneuvering about this type of climbing wall. First, the location of the holds on the wall vary according the level of skill of a particular climber. Second, the shape of the individual holds can be modified in order to make them easier or more difficult to grasp.

Using artificial climbing walls to simulate outdoor rock climbing activity is well known. Artificial climbing walls provide rock-climbing enthusiasts with the opportunity to simulate outdoor rock climbing activity at an easily accessible location. The climbing holds are normally attached to a wall using bolts or threaded rods. The climbing holds are typically of varying shapes and textures that affect the level of skill required to maneuver on the climbing wall. In particular, climbing walls that have a minimal number of holds are harder to grasp and make the wall harder to negotiate. Another factor affecting the level of skill required to maneuver on the climbing wall is the position of the climbing holds on the climbing wall. The closer the climbing holds are positioned relative to one another, the more climbing holds there are available for grasping by a climber as the climber maneuvers on the climbing wall.

Prior art climbing holds present significant problems when attempting to properly secure them to a climbing wall. Climbing holds typically have an aperture extending therethrough in order to permit a bolt to extend and threadably engage the climbing wall. The bolt is tightened to secure the climbing hold to the wall and prevent the hold from either transitional or rotational movement. In order to ensure that the hold does not rotate, a bolt must be tightened to a certain torque such that the hold is tight against the wall and prevented from rotating by the frictional force existing between the planar mounting face of the hold and the opposing portion of the climbing wall. However, in attempting to prevent the climbing hold from moving, the bolt may be over tightened resulting in the molded body of the climbing hold to fracture. The head of the bolt upon engaging the upper body portion of the climbing hold creates an area of high stress concentration adjacent to the bolt head making the hold susceptible to cracking about this area. Accordingly, a narrowly acceptable range of torque results in order to ensure that the climbing hold is properly secured but not damaged. Fracture of the hold may lead to the hold falling from the wall upon being stressed by the weight of a climber. Since a climber may place all of their weight on a particular hold, its breaking may result in a fall that could injure the climber.

Known climbing holds have some limits and drawbacks. In fact, when holds are applied to and integrated into the climbing wall, the same are substantially fixed as regards positions, number and conformation, and substantially do not enable the climbing situations and problems to be changed in order to modify the degree of technical difficulty in climbing, unless specialized interventions and/or rearrangements involving manipulations are carried out. In addition, it should be noted that known climbing holds are heavy and of difficult, expensive and unquick construction.

Another problem associated with a climbing hold is that it has a tendency to loosen as climbers use it. Depending on how a climber grasps the climbing hold, the climber may generate a torque on the hold which could rotate (i.e., loosen) the hold from the climbing wall. The present invention overcomes this and other problems associated with the prior art.

SUMMARY OF THE INVENTION

A wall-climbing accessory adapted for mounting onto a wall structure is described. The wall-climbing accessory comprises a resilient body that is flexible such that the resilient body may deform when mounted to a wall structure. The resilient body comprises an exterior surface and an edge. The exterior surface is configured and arranged to provide an engagement point capable of supporting a climber of the wall structure, whereby a climber may scale a wall structure by using the wall-climbing accessory. The edge is configured to substantially engage the wall structure such that, when affixed, the resilient body and edge impart a torsion force to the wall structure such that a flexible, friction fit is formed between the wall-climbing accessory and the wall structure. The wall-climbing accessory uses only one primary fastener to attach to the wall structure and thus is less prone to rotation than prior art climbing holds. Additional screws may be added to a periphery of the wall-climbing accessories for extra protection against rotation. Furthermore, the resilient body is flexible and lighter when compared to prior art climbing holds. Additional advantages and features of the invention will be set forth in part in the description that follows, and in part, will become apparent to those skilled in the art upon examination of the following or may be learned by practice of the invention.

DETAILED DESCRIPTION

Figures 1, 2, 3, 4, 5, 5A:
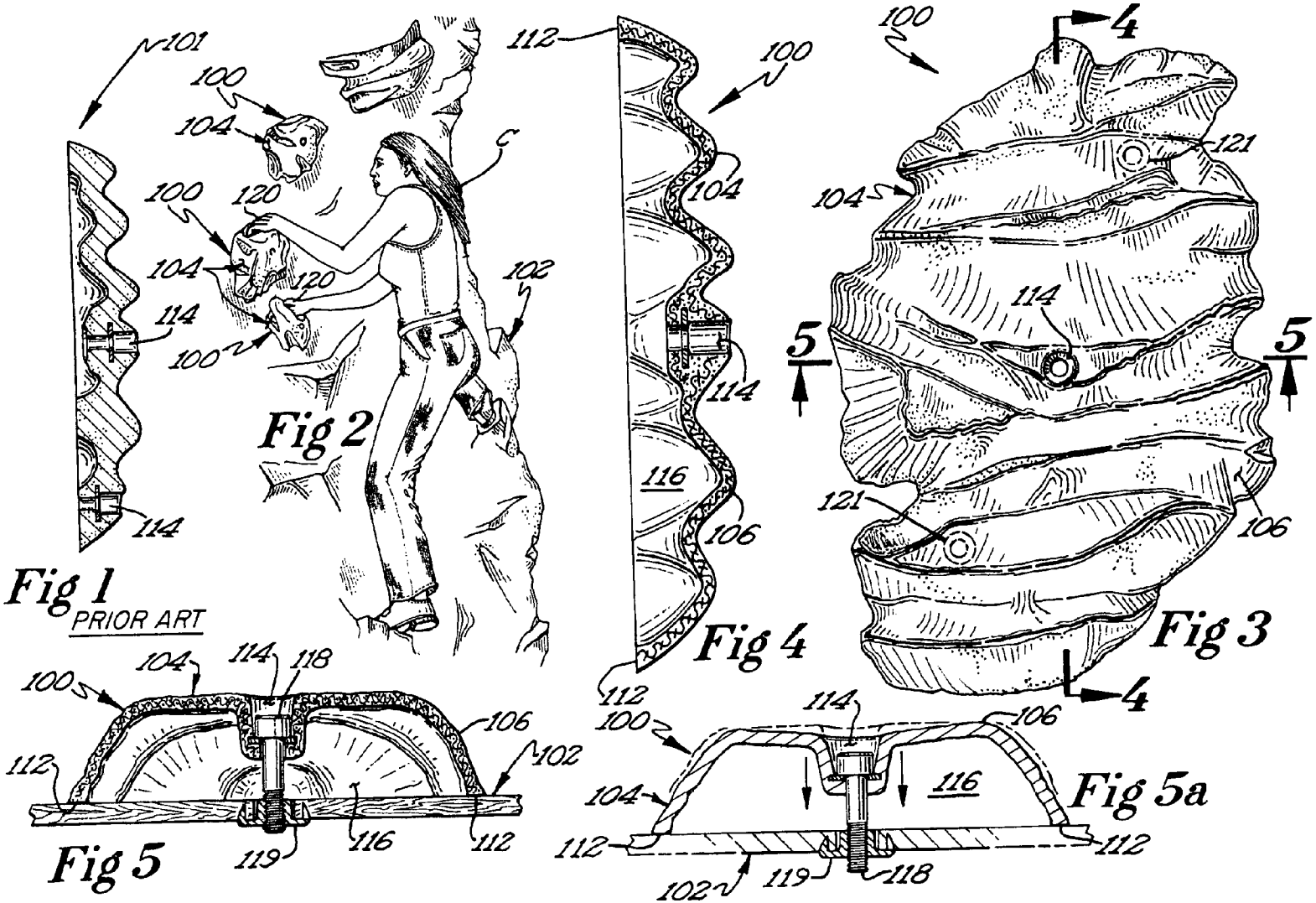
Fig 1 PRIOR ART
FIG. 1 is a cross sectional view of a prior art climbing hold.
FIG. 2 is a perspective view of wall climbing accessories mounted on a wall structure and in use by a climber.
FIG. 3 is a front-elevation view of the wall-climbing accessory.
FIG. 4 is a section cut along line 4-4 of FIG. 3 of the wall-climbing accessory.
FIG. 5 is a section cut along line 5-5 of FIG. 3 of the wall-climbing accessory.
FIG. 5*a* is a section similar to FIG. 5 of the wall-climbing accessory, in tension.

FIG. 1 is a cross-sectional view of a prior art climbing hold 101. Prior art climbing holds 101 are heavier, take up more volume, and are more rigid than applicant's wall climbing accessory 100. Furthermore, some prior art climbing holds 101 are solid. Therefore, those prior art climbing holds 101 are extremely heavy and rigid. In addition, it is worth noting that prior art climbing holds 101 often utilize more than one fastener to secure the hold to a wall. For purposes of this explanation, a wall-climbing accessory 100 is a type of climbing hold.

FIG. 2 is a perspective view of wall climbing accessories 100 mounted on a wall structure 102 in use by a climber C. Several wall-climbing accessories 100 are variably mounted to a wall structure 102. It will be appreciated by those skilled in the art that during construction, the wall structure 102 is made first, the wall climbing accessories 100 are mounted to the wall structure 102 second. In preferred embodiments, the wall structure 102 is made from plywood with a concrete coating. However, it will be appreciated by those skilled in the art that the wall structure 102 may be made from a polymer such as roto-molded polyethylene panels, PVC, or PMA. It will also be appreciated by those skilled in the art that the wall structure 102 may be made from solid concrete. The wall structure 102 may also be made with a combination of polymer and concrete, or various materials known in the art. The problems associated with rotating prior art climbing holds 101 are more severe in polymer and solid concrete walls due to slippery and uneven surfaces. It will also be appreciated by those skilled in the art that t-nuts 119 are installed or threaded through from the back of the wall structure 102. The wall-climbing accessory 100 is installed onto the t-nut 119 via a fastener, or bolt 118. One advantage of the wall-climbing accessory 100 is that it is easy to install and uninstall to provide a variety of grips on the wall structure 102 because only one fastener is necessary to hold the wall-climbing accessory 100 to the wall structure 102. It will be appreciated by those skilled in the art that route setters change the position of the wall climbing accessories 100 frequently. Prior art climbing holds 101 utilize multiple fasteners to affix to the wall structure 102, making it difficult to change the position of the climbing hold quickly.

FIG. 3 is a front-elevation view of the wall-climbing accessory 100. 121 are phantom depictions of optional locations for recessed fastener openings 114. A resilient body 104 of the wall-climbing accessory 100 has an exterior surface 106 and an edge 112. It will be understood by those skilled in the art that a washer or other load distributing device may be embedded into the recessed fastener opening 114 during assembly of the wall climbing accessory 100 for stress concentration purposes. The wall-climbing accessory 100 is less brittle than the prior art 101 due to a different means of manufacturing the apparatus. Commonly, the prior art method uses a silicon mold that is filled with liquid material that cures and hardens into the final product. In some prior art methods, plugs are used during the casting process to make the climbing hold hollow for reducing weight. However, these climbing holds remain heavy and rigid. The new manufacturing process can utilize either a spray on technique or injection mold process. Plugs are no longer needed. It is important to note that in preferred alternative embodiments, the wall-climbing accessory 100 may also be made from overlaying patches of fiber-reinforced mesh. In the preferred embodiments of spray on technique or injection mold, a piece of equipment known as a chopper gun is used. The matrix material, generally polyester resin and glass fiber, is sprayed onto the mold at the same time. The matrix material covers the glass fibers while the material is being sprayed and the resulting composite is then consolidated by hand using rollers and paintbrushes. This process is inexpensive and requires no special tooling. The outer coat of the wall climbing accessory 100 consists of a colored material (gel coat) and the inner coat is random, discontinuous strands of fiberglass resin. It will be understood by those skilled in the art that any fiber-reinforced polymer can be substituted. However, in preferred embodiments fiberglass resin is used.

There is a greater percentage of glass fibers in the wall climbing accessory 100 than in prior art climbing holds 101. Prior art climbing holds 101, which are not easily deformed (not flexible) typically have a ratio of 2% glass fibers to 98% polyester resin and fillers. This makes the prior art climbing holds 101 heavy, non-resilient, and stiff. The wall-climbing accessory 100 is composed of approximately 50% glass fibers and 50% fiber reinforced polymers or polyester resin. Consequently, the wall-climbing accessory 100 is less prone to breakage and is flexible. Moreover, the wall climbing accessory 100 is resilient and forgiving of the climber's C, grip during climbing.

FIG. 4 is a section cut along line 4-4 of FIG. 3 of the wall-climbing accessory 100. A cavity 116, which is defined by the resilient body 104, is shown. The resilient body 104 has extra flexible properties as compared to the prior art holds 101. Furthermore, cavity 116 in the resilient body 104 is larger than the cavities in prior art 101 thereby making the wall climbing accessory 100 lighter as compared to prior art climbing wall holds 101. Another feature of the wall climbing accessory 100 is that due to its lighter weight than prior art handholds 101, it is easier to carry up the wall structure 102 for installation purposes. This is safer for hauling climbing holds up and down wall structures 102.

Furthermore, the edge 112 that is formed along the resilient body 104 is capable of flexing and forming to a wall structure 102 that may be textured, contoured, or featured surface. The edge 112 is an engaging perimeter, which frictionally engages the wall structure 102. The reverse sides of prior art climbing holds 101 are generally planar, causing more rotation and slippage.

FIG. 5 is a section cut along line 5-5 of FIG. 3 of the wall-climbing accessory 100. The wall-climbing accessory 100 has a bolt 118 inserted through a recessed fastener opening 114. The bolt 118 is inserted through the recessed fastener opening 114 as a means to attach the resilient body 104 to the t-nut 119 in the wall structure 102. A washer helps prevent the bolt 118 from damaging or cracking the resilient body 104 during installation. It will be appreciated by those skilled in the art that the recessed fastener opening 114 need not be recessed, it may be level to or protruding above the exterior surface 106. In addition, it will also be appreciated by those skilled in the art that the t-nut 119 and bolt 118 may be interchanged with pop rivets, screws, nails, and standard nut and bolt arrangements. Some varieties of the standard nut and bolt arrangement include but are not limited to socket head cap-screws, hex head bolts, button head cap-screws, or flat head cap-screws.

FIG. 5*a* is a section similar to FIG. 5 of the wall-climbing accessory 100, in tension. The bolt 118 is tightened to the t-nut 119. The edge 112 frictionally engages the wall structure 102, causing a torqued fit of the resilient body 104. The wall-climbing accessory 100 will not shift if gripped by a climber C. Another advantage of the wall-climbing accessory 100 is that it does not have a tendency to rotate around the bolt 118. More surface opening than prior art climbing holds 101 make the wall climbing accessory 100 more anti-rotation. Less surface area engages the wall structure 102, thereby giving more force and grip to the wall. The prior art climbing holds 101 have smaller cavities and are thus less hollow. Therefore, more flat surface area engages the wall structure 102, thereby increasing the likelihood of rotation. Prior art climbing holds 101 are stiff and unyielding and present a large, smooth area of contact against the wall surface which then lends itself to rotational motion of the hold due to its stiff and unyielding qualities. However, the wall-climbing accessory 100 has the ability to deform and thus "dig in" to the surface of wall structure 102.

Figure 6:
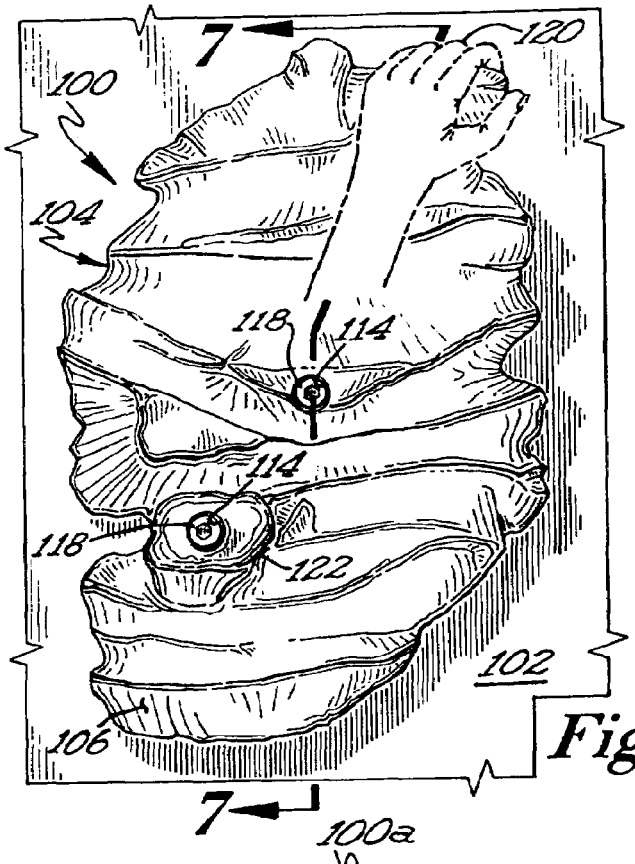
FIG. 6 is a front elevation view of a second version of the wall-climbing accessory mounted and in use.

FIG. 6 is a front elevation view of a second version of the wall-climbing accessory 100 mounted and in use. A hand 120 is shown in phantom to give an example of where a rock climber C may grip the exterior surface 106. Furthermore, in preferred embodiments the resilient body 104 may have an additional modular accessory 122 protruding from the exterior surface 106 for purposes of providing variety of grip to the climber C. The additional modular accessory 122 is constructed from material similar to the wall-climbing accessory 100. The additional modular accessory 122 is typically mounted on flat spots and cross sections of the wall-climbing accessory 100. In preferred embodiments the additional modular accessory 122 is fastened to the exterior surface 106 via a fastener similar to the t-nut 119 and bolt 118 system that extends to the wall structure 102. In alternative preferred embodiments the additional modular accessory 122 is mounted only to the exterior surface 106 via a fastener similar to the t-nut 119 and bolt 118 system. In the alternative preferred embodiment, the t-nut 119 and bolt 118 does not extend to the wall structure 102.

Figure 7:
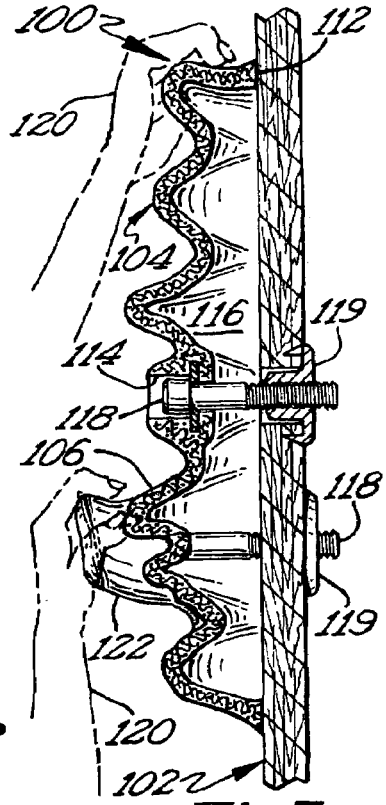
FIG. 7 is a cross sectional view of the second version of the wall-climbing accessory taken along lines 7-7 of FIG. 6, mounted and in use.

FIG. 7 is a cross sectional view of the second version of the wall-climbing accessory 100 taken along lines 7-7 of FIG. 6, mounted and in use.

Figure 8:
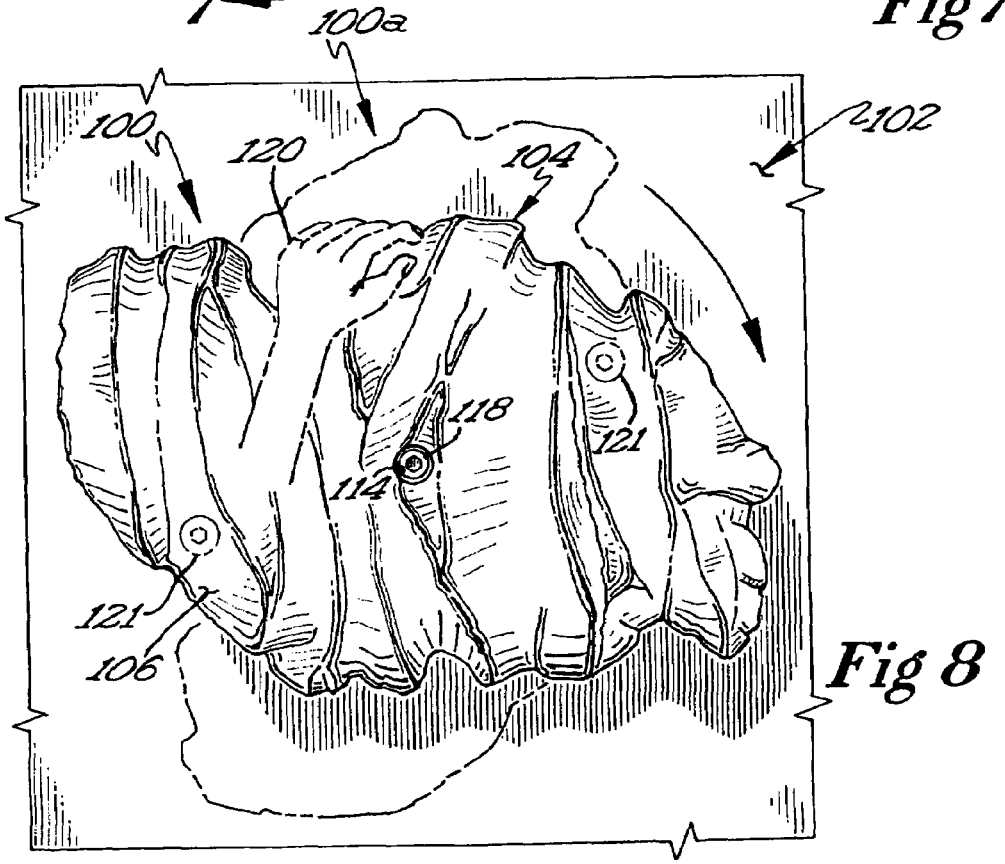
FIG. 8 is a front elevation view of the wall-climbing accessory, mounted, rotated 90 degrees from the original position in FIG. 6, and in use.

FIG. 8 is a front elevation view of the wall-climbing accessory 100*a*, mounted, rotated 90 degrees from the original position in FIG. 6, and in use. FIG. 8 shows the same wall-climbing accessory 100 of FIG. 6 rotated 90 degrees and secured via the bolt 118 in the recessed fastener opening 114. This provides a variety of grips for the climber C and also aids in increasing the challenge of a competition. It will be appreciated by those skilled in the art that the wall climbing accessory 100 may be rotated greater than or less than 90 degrees.

It will be appreciated by those skilled in the art that the wall-climbing accessory 100 may have a ridge, rib, or bridge that engage the wall structure 102 in addition to or alternative to the edge 112. Also, the wall-climbing accessory 100 may be toroid shaped or be other shapes that have holes formed therethrough. Furthermore, the wall-climbing accessory 100 may have more than one recessed fastener opening 114 and bolt 118 affixing the apparatus to the wall structure 102, as seen in phantom in FIGS. 3 and 8. However, in preferred embodiments only one central fastener is necessary to affix the apparatus to the wall structure 102 because of the friction fit formed by the resilient body 104 and edge 112.

Moreover, the wall-climbing accessory 100 may have an irregular exterior surface 106 for simulating a natural rock structure. The exterior surface 106 may also have identifying insignia or marks for aesthetic or competition purposes. In addition, an asymmetrical sidewall or walls may be included into the resilient body 104. Another advantage of the wall-climbing accessory 100 is that each apparatus of the same shape has the same hollowed out portion, therefore the accessories may be stacked, or nested, together for ease in carrying and shipping.

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed.

What is claimed is:

1. A wall-climbing accessory adapted for mounting onto a wall structure only by a separate fastener, the wall climbing accessory comprising:

a resilient body that is flexible such that the resilient body may deform when mounted to the wall structure, the resilient body comprising an exterior surface, the exterior surface being configured and arranged to provide an engagement point capable of supporting a climber of the wall structure, whereby a climber may scale a wall structure by using the wall climbing accessory;

an edge that is formed along the resilient body, the edge configured to substantially engage the wall structure such that, when affixed, the edge imparts a torsion force to the wall structure such that a flexible, friction fit to the wall structure is formed without vacuum between the wall climbing accessory and the wall structure;

at least one cavity defined by the resilient body to be connected to the exterior surface; and at least one recessed fastener opening passing through a radius of the exterior surface and the resilient body to connect the cavity to the exterior surface and preclude any vacuum within the cavity, the recessed fastener opening configured to receive the separate fastener extending through the exterior surface and the resilient body and into the wall structure.

2. The wall-climbing accessory of claim 1 wherein the cavity has a ridge, rib or bridge that is adapted to engage the wall structure.

3. The wall-climbing accessory of claim 1 wherein the wall-climbing accessory has at least one additional modular accessory affixed to a region of the exterior surface.

4. The wall-climbing accessory of claim 1 wherein the recessed fastener opening receives a standard bolt as a fastener.

5. The wall-climbing accessory of claim 1 wherein the recessed fastener opening receives a socket head capscrew, hex head bolt, button head capscrew, or flat head capscrew as a fastener.

6. The wall-climbing accessory of claim 1 wherein the wall-climbing accessory has two or more recessed fastener openings.

7. The wall-climbing accessory of claim 1 wherein the recessed fastener opening receives a fastener selected from the group consisting of: pop rivets, screws, nails, and standard nut and bolt arrangements.

8. The wall-climbing accessory of claim 1 wherein the exterior surface has an irregular shape for simulating a natural rock structure.

9. The wall-climbing accessory of claim 1 wherein the wall-climbing accessory further includes an asymmetrical sidewall.

10. The wall-climbing accessory of claim 1 wherein the wall-climbing accessory is constructed from fiberglass resin, polyurethane, or other polymer-based substance.

11. The wall-climbing accessory of claim 1 wherein the exterior surface shows identifying insignia.

12. The wall-climbing accessory of claim 1 wherein the resilient body is shaped from sprayed fiberglass layers.

13. The wall-climbing accessory of claim 1 wherein the resilient body is made by overlaying patches of fiber-reinforced mesh.

14. The wall-climbing accessory of claim 1 wherein each accessory can be nested or stacked on top of one another.

* * * * *